US006354304B1

(12) United States Patent
Chang

(10) Patent No.: US 6,354,304 B1
(45) Date of Patent: Mar. 12, 2002

(54) ARTIFICIAL NAIL HAVING CLEAR NAIL BED PORTION AND FRENCH MANICURE

(75) Inventor: Yong Jin Chang, Manhasset, NY (US)

(73) Assignee: Kiss Products, Inc., Port Washington, NY (US)

( * ) Notice: Subject to any disclaimer, the term of this patent is extended or adjusted under 35 U.S.C. 154(b) by 0 days.

(21) Appl. No.: 09/616,404

(22) Filed: Jul. 14, 2000

(51) Int. Cl.[7] ..... A45D 29/00
(52) U.S. Cl. ..... 132/200; 132/73
(58) Field of Search ..... 132/73, 73.5, 285, 132/200, 74.5; 206/581, 813, 81

(56) References Cited

U.S. PATENT DOCUMENTS 1,942,332 A * 1/1934 Hamberg ..... 132/73
2,633,139 A * 3/1953 Pettey ..... 132/73
3,786,821 A * 1/1974 Noskin ..... 132/200
3,982,551 A * 9/1976 Bartolucci ..... 132/73
4,615,348 A * 10/1986 Nakata et al. ..... 132/73
5,658,415 A * 8/1997 Montemurro et al. ..... 132/73
5,782,248 A * 7/1998 Chang ..... 132/200

FOREIGN PATENT DOCUMENTS

FR 2241272 * 3/1975 ..... 132/73

* cited by examiner

*Primary Examiner*—Todd E. Manahan
*Assistant Examiner*—David C. Comstock
(74) *Attorney, Agent, or Firm*—Hoffmann & Baron, LLP

(57) ABSTRACT

An artificial fingernail, fingernail kit and a method of applying the artificial fingernails to natural nails. The artificial fingernail comprises a nail body made from transparent plastic and having a nail bed portion and a nail tip portion. The nail bed portion corresponds in size and shape to the nail bed of a natural fingernail and is applied over a natural fingernail. The nail tip portion contains opaque decorations that obscure a natural nail tip when the artificial fingernail is applied over a natural fingernail. The artificial fingernail is applied to the natural nail with a translucent pink adhesive. This way, the artificial fingernail has the color and appearance of a natural fingernail. This is especially important when doing a french manicure.

6 Claims, 1 Drawing Sheet

ARTIFICIAL NAIL HAVING CLEAR NAIL BED PORTION AND FRENCH MANICURE

BACKGROUND OF THE INVENTION

1. Field of the Invention

This invention relates to an artificial nail and to a method of applying the artificial nail to a natural fingernail. In particular, the invention relates to an artificial nail that has the appearance of a natural nail once it is applied.

2. The Prior Art

Traditional artificial fingernails are made of an opaque hard, flexible plastic. They are applied over natural nails with an adhesive and then covered with nail polish. These nails look like natural nails only when covered with polish, because the artificial nails completely obscure the natural nail bed underneath.

Because of the opacity of the artificial nails, a french-style manicure is impossible. A french manicure is one in which only the nail tip is colored, (usually white) and the nail bed is left a natural color or tinted only slightly pink. Attempts at a french manicure with artificial nails do not look natural, because the opaque artificial nail bed portion cannot be made to look like a natural nail bed.

SUMMARY OF THE INVENTION

It is therefore an object of the invention to provide an artificial nail and a method for applying the nail, in which the natural nail bed is visible, and the entire nail looks as if it were a natural nail.

It is another object of the invention to provide an artificial nail that can be easily applied by a consumer without the need for an experienced nail technician.

It is a further object of the invention to provide an artificial nail that is simple and inexpensive to manufacture.

These and other objects of the invention are accomplished by an artificial fingernail comprising a nail body made from transparent material and having a nail bed portion and a nail tip portion. The nail bed portion corresponds in size and shape to the nail bed of a natural fingernail and is applied over a natural fingernail. The nail tip portion contains opaque decorations that obscure a natural. nail tip when the artificial fingernail is applied over a natural fingernail. This way, the artificial fingernail has the color and appearance of a natural fingernail. This is especially important when doing a french manicure.

The artificial nail is preferably made from ABS (acrylonitrile butadiene styrene) plastic. However, other materials could also be used.

To give the appearance of a french manicure, the opaque decorations comprise white paint over the entire nail tip portion. Other decorations could also be done. To give an even more decorative appearance, decorative designs can be applied over all or a portion of the nail. Such designs can include air-brushed or printed flowers, birds, or any other designs. These designs are used in addition to the decoration that covers the area corresponding to a natural nail tip. It is important that the natural nail tip not be visible through the artificial nail, because the artificial nail would not look natural. Only the natural nail bed is visible through the artificial nail.

The artificial nail is preferably coated with a top coat of transparent sealer to protect the decoration and designs. Thus, the nail comes pre-finished and does not need any additional polish once it is applied to the natural fingernails.

The invention also includes an artificial fingernail fingernail kit, comprising at least 10 of the artificial nails described above, along with a portion of a translucent pink adhesive. The adhesive is preferably an ethylcyanoacrylate, but other adhesives could also be used. The natural nail color is visible through both the adhesive and artificial nail when the artificial nail is applied to a natural nail with the adhesive.

The invention also comprises a method of applying artificial fingernails, comprising applying the translucent pink adhesive to the artificial nail described above, and placing the artificial nail over a natural nail, so that the natural nail bed is visible through the artificial nail and the adhesive.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
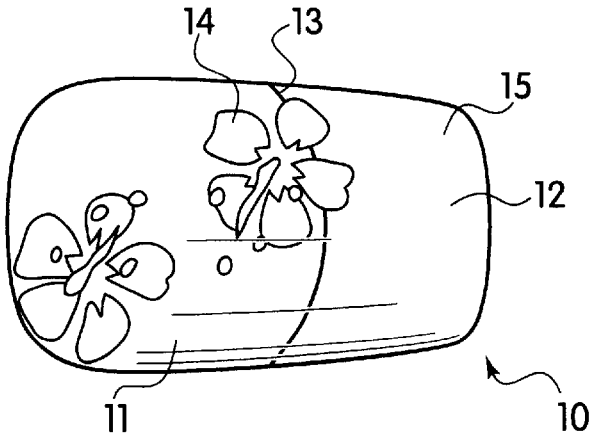
FIG. 1 shows a top view of the artificial nail according to the invention.
Figure 2:
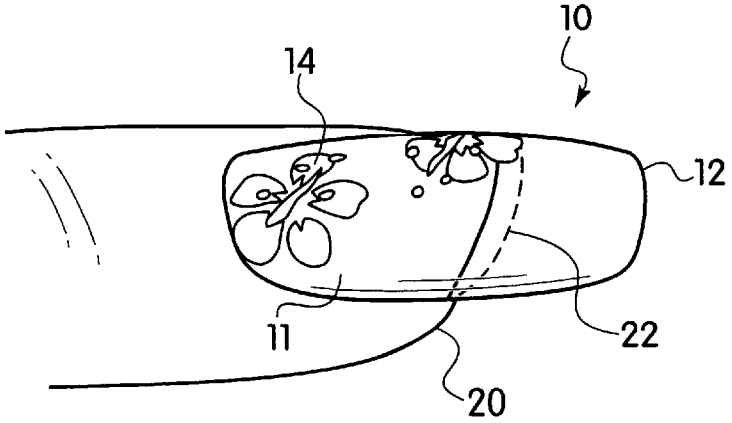
FIG. 2 shows a side view of the artificial nail as applied to a natural fingernail.

Referring now in detail to the drawings FIGS. 1 and 2 show the artificial nail 10 according to the invention. Artificial nail 10 is made of a transparent plastic and comprises a nail bed portion 11, and a nail tip portion 12. The dividing line 13 between bed portion 11 and tip portion 12 corresponds to the transition of a natural nail from bed to tip. Tip portion 12 is painted with an opaque white paint 15 to resemble a french manicure. Additional designs 14 are applied over the bed portion 11 and tip portion 12 to enhance the nail's appearance.

Figure 3:
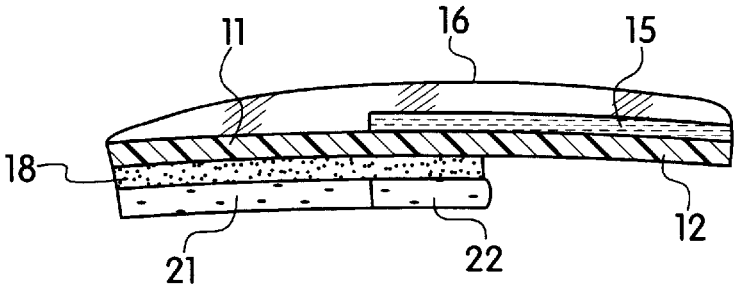
FIG. 3 shows a schematic cross-sectional view of the layers of natural nail, artificial nail and paint according to the invention.

To apply nail 10 to a natural fingernail, a translucent pink adhesive 18, shown in FIG. 3, is applied to nail bed portion 11, in a conventional manner. Nail 10 is then placed on top of a natural nail 21 on finger 20, as shown in FIGS. 2 and 3. The natural nail tip 22 extends out under tip portion 12, but is not visible through nail 10, due to the decoration painted on nail tip 12. However, nail bed portion 11 is transparent, and the natural nail bed 21 is visible though bed portion 11. This way, artificial nail 10 resembles a natural nail. Preferably, a transparent top coat easier 16 is applied over the entire artificial nail to protect decoration 15.

The artificial nails 10 according to the invention preferably made of ABS plastic, and can be trimmed and ed to a desired size and shape. Accordingly, while only a single embodiment of the sent invention has been shown and described, it is obvious that many changes and modifications may be made thereunto without departing from the spirit and scope of the invention.

What is claimed is:

1. An artificial fingernail, comprising a nail body made from transparent material and having a nail bed portion and a nail tip portion that generally corresponds to the transition of a natural nail from bed to tip, the nail bed portion being entirely substantially clear and transparent and corresponding in size and shape to the nail bed of a natural fingernail, and adapted to be adhered to a natural fingernail to display substantially of the natural nail bed therethrough, all and said nail tip portion being painted with an opaque decoration that obscures a natural nail tip when said artificial fingernail is applied over a natural fingernail.

2. The artificial fingernail according to claim 1, wherein the opaque decoration comprises white paint covering the entire nail tip portion, to give the appearance of a french manicure.

3. The artificial fingernail according to claim 1, further comprising decorative designs applied over the entire fingernail.

4. The artificial fingernail according to claim 1, further comprising a transparent sealer applied over the artificial nail, to protect the decoration.

5. An artificial fingernail kit, comprising:

at least ten artificial fingernails, each nail comprising a nail body made from transparent plastic and having a nail bed portion and a nail tip portion and a dividing line between the nail bed portion and the nail tip portion that generally corresponds to the transition of a natural nail from bed to tip, the nail bed portion being entirely substantially clear and transparent and corresponding in size and shape to the nail bed of a natural fingernail, and adapted to be adhered to a natural fingernail to display substantially all of the natural nail bed to be visible therethrough, wherein said nail tip portion contains an opaque decoration painted thereon that obscures a natural nail tip when said artificial fingernail is applied over a natural fingernail; and a translucent pink adhesive, wherein the natural nail color is visible through the adhesive and artificial nail when the artificial nail is applied to a natural nail with the adhesive.

6. A method of applying artificial fingernails, comprising:

applying a translucent pink adhesive to an artificial nail, said artificial nail comprising a nail body made from transparent material and having a nail bed portion and a nail tip portion and a dividing line between the nail bed portion and the nail tip portion that generally corresponds to the transition of a natural nail from bed to tip, the nail bed portion corresponding in size and shape to the nail bed of a natural fingernail, and said nail tip portion being entirely substantially clear and transparent and being painted with an opaque decoration that obscures a natural nail tip when said artificial fingernail is applied over a natural fingernail, wherein said adhesive is applied to the nail bed portion only; and placing the nail bed portion over a natural nail bed, such that the dividing line of the artificial nail is substantially aligned with the transition of the natural nail from bed to tip wherein the artificial nail adheres to the natural nail bed and the natural nail bed is visible through the adhesive and the nail bed portion of the artificial nail.

* * * * *

UNITED STATES PATENT AND TRADEMARK OFFICE

CERTIFICATE OF CORRECTION

PATENT NO. : 6,354,304 B1
DATED : March 25, 2002
INVENTOR(S) : Yong Jin Chang

It is certified that error appears in the above-identified patent and that said Letters Patent is hereby corrected as shown below:

Title page, Item [54] and Column 1, line 1,
Now reads "ARTIFICIAL NAIL HAVING CLEAR NAIL BED PORTION AND FRENCH MANICURE" should read -- ARTIFICIAL NAIL AND METHOD OF APPLYING SAME --;

Column 2,
Line 54, now reads "top coat easier 16" should read -- top coat sealer 16 --;
Line 57, now reads "trimmed and ed" should read -- trimmed and filed --;
Line 59, now reads "embodiment of the sent" should read -- embodiment of the present --;

Column 2, lines 24-67 through Column 3, lines 1-7,
In claim 1 now reads "1. An artificial fingernail, comprising a nail body made from transparent material and having a nail bed portion and a nail tip portion that generally corresponds to the transition of a natural nail from bed to tip, the nail bed portion being entirely substantially clear and transparent and corresponding in size and shape to the nail bed of a natural fingernail, and adapted to be adhered to a natural fingernail to display substantially of the natural nail bed therethrough, all and said nail tip portion being painted with an opaque decoration that obscures a natural nail tip when said artificial fingernail is applied over a natural fingernail."

should read --1. An artificial fingernail, comprising a nail body made from transparent material and having a nail bed portion and a nail tip portion and a dividing line between the nail bed portion and the nail tip portion that generally corresponds to the transition of a natural nail from bed to tip, the nail bed portion being entirely substantially clear and transparent and corresponding in size and shape to the nail bed of a natural fingernail, and adapted to be adhered to a natural fingernail to display substantially all of the natural nail bed therethrough, and said nail tip portion being painted with an opaque decoration that obscures a natural nail tip when said artificial fingernail is applied over a natural fingernail.--

UNITED STATES PATENT AND TRADEMARK OFFICE

CERTIFICATE OF CORRECTION

PATENT NO. : 6,354,304 B1
DATED : March 25, 2002
INVENTOR(S) : Yong Jin Chang

It is certified that error appears in the above-identified patent and that said Letters Patent is hereby corrected as shown below:

Column 3, lines 18-30 through Column 4, lines 1-7,

In claim 5 now reads "5. An artificial fingernail kit, comprising:

at least ten artificial fingernails, each nail comprising a nail body made from transparent plastic and having a nail bed portion and a nail tip portion and a dividing line between the nail bed portion and the nail tip portion that generally corresponds to the transition of a natural nail from bed to tip, the nail bed portion being entirely substantially clear and transparent and corresponding in size and shape to the nail bed of a natural fingernail, and adapted to be adhered to a natural fingernail to display substantially all of the natural nail bed to be visible therethrough, wherein said nail tip portion contains an opaque decoration painted thereon that obscures a natural nail tip when said artificial fingernail is applied over a natural fingernail; and a translucent pink adhesive, wherein the natural nail color is visible through the adhesive and artificial nail when the artificial nail is applied to a natural nail with the adhesive."

should read --5. An artificial fingernail kit, comprising:

at least ten artificial fingernails, each nail comprising a nail body made from transparent plastic and having a nail bed portion and a nail tip portion and a dividing line between the nail bed portion and the nail tip portion that generally corresponds to the transition of a natural nail from bed to tip, the nail bed portion being entirely substantially clear and transparent and corresponding in size and shape to the nail bed of a natural fingernail, and adapted to be adhered to a natural fingernail to display substantially all of the natural nail bed therethrough, wherein said nail tip portion contains an opaque decoration painted thereon that obscures a natural nail tip when said artificial fingernail is applied over a natural fingernail; and a translucent pink adhesive, wherein the natural nail color is visible through the adhesive and artificial nail when the artificial nail is applied to a natural nail with the adhesive.--

UNITED STATES PATENT AND TRADEMARK OFFICE

CERTIFICATE OF CORRECTION

PATENT NO. : 6,354,304 B1
DATED : March 25, 2002
INVENTOR(S) : Yong Jin Chang

It is certified that error appears in the above-identified patent and that said Letters Patent is hereby corrected as shown below:

Column 4, lines 8-28,

In claim 6 now reads "6. A method of applying artificial fingernails, comprising:

applying a translucent pink adhesive to an artificial nail, said artificial nail comprising a nail body made from transparent material and having a nail bed portion and a nail tip portion and a dividing line between the nail bed portion and the nail tip portion that generally corresponds to the transition of a natural nail from bed to tip, the nail bed portion corresponding in size and shape to the nail bed of a natural fingernail, and said nail tip portion being entirely substantially clear and transparent and being painted with an opaque decoration that obscures a natural tip when said artificial fingernail is applied over a natural fingernail, wherein said adhesive is applied to the nail bed portion only; and placing the nail bed portion over a natural nail bed, such that the dividing line of the artificial nail is substantially aligned with the transition of the natural nail from bed to tip wherein the artificial nail adheres to the natural nail bed and the natural nail bed is visible through the adhesive and the nail bed portion of the artificial nail."

should read--6. A method of applying artificial fingernails, comprising:

applying a translucent pink adhesive to an artificial nail, said artificial nail comprising a nail body made from transparent material and having a nail bed portion and a nail tip portion and a dividing line between the nail bed portion and the nail tip portion that generally corresponds to the transition of a natural nail from bed to tip, the nail bed portion being entirely substantially clear and transparent and corresponding in size and shape to the nail bed of a natural fingernail, and said nail tip

UNITED STATES PATENT AND TRADEMARK OFFICE

CERTIFICATE OF CORRECTION

PATENT NO. : 6,354,304 B1
DATED : March 25, 2002
INVENTOR(S) : Yong Jin Chang

It is certified that error appears in the above-identified patent and that said Letters Patent is hereby corrected as shown below:

Column 4, lines 8-28, (cont.)

portion being painted with an opaque decoration that obscures a natural nail tip when said artificial fingernail is applied over a natural fingernail, wherein said adhesive is applied to the nail bed portion only; and placing the nail bed portion over a natural nail bed, such that the dividing line of the artificial nail is substantially aligned with the transition of the natural nail from bed to tip wherein the artificial nail adheres to the natural nail bed to display substantially all of the natural nail bed through the adhesive and the nail bed portion of the artificial nail.--

Signed and Sealed this

Sixteenth Day of September, 2003

JAMES E. ROGAN
*Director of the United States Patent and Trademark Office*

US006354304C1

(12) INTER PARTES REEXAMINATION CERTIFICATE (0030th)

United States Patent

Chang

(10) Number: US 6,354,304 C1

(45) Certificate Issued: Jul. 22, 2008

(54) ARTIFICIAL NAIL AND METHOD OF APPLYING SAME

(75) Inventor: Yong Jin Chang, Manhasset, NY (US)

(73) Assignee: Kiss Nail Products, Inc.

Reexamination Request:
No. 95/000,023, Jul. 17, 2003

Reexamination Certificate for:

| | |
|---|---|
| Patent No.: | **6,354,304** |
| Issued: | **Mar. 12, 2002** |
| Appl. No.: | **09/616,404** |
| Filed: | **Jul. 14, 2000** |

Certificate of Correction issued Sep. 16, 2003.

(51) Int. Cl.

| | |
|---|---|
| ***A45D 7/00*** | (2006.01) |
| ***A45D 24/00*** | (2006.01) |
| ***A45D 29/00*** | (2006.01) |

(52) U.S. Cl. ..... 132/200; 132/73

(58) Field of Classification Search ..... None
See application file for complete search history.

(56) References Cited

U.S. PATENT DOCUMENTS

| | | | | |
|---|---|---|---|---|
| 1,942,332 A | | 1/1934 | Hamberg | |
| 4,615,348 A | | 10/1986 | Nakata | |
| 4,751,935 A | * | 6/1988 | Mast et al. | 132/73 |
| 5,704,375 A | | 1/1998 | Wood | |
| 5,782,248 A | | 7/1998 | Chang | |
| 5,873,375 A | * | 2/1999 | Johnson et al. | 132/200 |
| 5,908,035 A | | 6/1999 | Carroll | |

FOREIGN PATENT DOCUMENTS

JP 9-201223 8/1997

OTHER PUBLICATIONS

Nailpro The Magazine for Professionals, vol. 10, No. 4, Apr. 1999, cover page and p. 32.*

Nailpro The Magazine for Professionals, vol. 7, No. 12, Dec. 1996 cover page, Competition Formula 3000 advertisement page, OPI advertisement page, and Nails 2000 International advertisement page.*

Nail Max '99, Eichi Publishing Co., Ltd. Jul. 5, 1999, Japan Date of publication is on p. 112.

Nail Max 2000m Eichi Publishing Co., Ltd., Dec. 15, 1999, Japan. Date of publication is on p. 128.

* cited by examiner

*Primary Examiner*—Beverly M. Flanagan

(57) ABSTRACT

An artificial fingernail, fingernail kit and a method of applying the artificial fingernails to natural nails. The artificial fingernail comprises a nail body made from transparent plastic and having a nail bed portion and a nail tip portion. The nail bed portion corresponds in size and shape to the nail bed of a natural fingernail and is applied over a natural fingernail. The nail tip portion contains opaque decorations that obscure a natural nail tip when the artificial fingernail is applied over a natural fingernail. The artificial fingernail is applied to the natural nail with a translucent pink adhesive. This way, the artificial fingernail has the color and appearance of a natural fingernail. This is especially important when doing a french manicure.

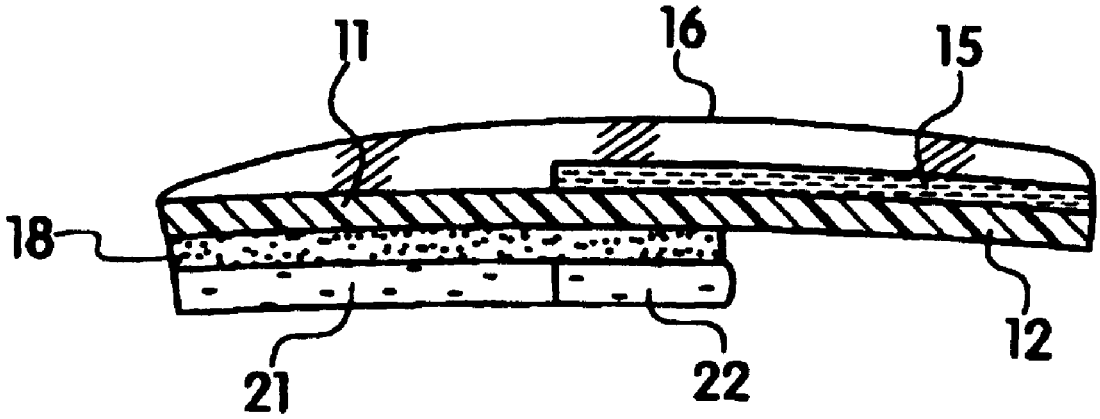

INTER PARTES REEXAMINATION CERTIFICATE ISSUED UNDER 35 U.S.C. 316

THE PATENT IS HEREBY AMENDED AS INDICATED BELOW.

AS A RESULT OF REEXAMINATION, IT HAS BEEN DETERMINED THAT:

The patentability of claims 5 and 6 is confirmed.

Claims 1–4 are cancelled.

* * * * *